United States Patent [19]

D'Aleo et al.

[11] Patent Number: 4,924,151

[45] Date of Patent: May 8, 1990

[54] MULTI-ZONE, MULTI-SCENE LIGHTING CONTROL SYSTEM

[75] Inventors: Michael D'Aleo, Erwinna; Denis Darragh, Allentown; Jonathan Ference, Riegelsville; David Luchaco, Macungie; Michael J. Rowen, Center Valley; Joel S. Spira, Coopersburg, all of Pa.

[73] Assignee: Lutron Electronics Co., Inc., Coopersburg, Pa.

[21] Appl. No.: 251,496

[22] Filed: Sep. 30, 1988

[51] Int. Cl.[5] ..... H05B 37/02

[52] U.S. Cl. ..... 315/295; 315/292; 315/293; 315/294; 315/297

[58] Field of Search ..... 315/292, 293, 294, 295, 315/297

[56] References Cited

U.S. PATENT DOCUMENTS

| | | | |
|---|---|---|---|
| 3,668,467 | 6/1972 | Isaac | 315/292 |
| 3,706,914 | 12/1972 | Van Buren | 315/316 |
| 3,763,394 | 10/1973 | Blanchard | 315/294 |
| 4,095,139 | 6/1978 | Symonds et al. | 315/153 |
| 4,575,660 | 3/1986 | Zaharchuk et al. | 315/295 |
| 4,727,296 | 2/1988 | Zaharchuk et al. | 315/295 |
| 4,772,825 | 9/1988 | Tabor et al. | 315/312 |

OTHER PUBLICATIONS

Lutron Electronics Co.-Grafik Eye TM Preset Dimming Control Brochure P/N, 360-209.

Lutron Electronics Co.-Aurora Brochure P/N 362-165.

Prescolite Controls-Series 7 TM Brochure, pp. 1,2 SER 7-1, Electronics Diversified Inc.-Omega Brochure.

*Primary Examiner*—David Mis

*Attorney, Agent, or Firm*—James Riesenfeld

[57] ABSTRACT

A system for controlling power to multiple groups of lights requires only a few controls. The system permits power to each group of lights to be adjusted independently and, at the same time, to be stored for later recall. Several combinations of power levels can be stored, and a particular combination can be selected, for example, by pressing a corresponding push button. In a preferred embodiment, a single control permits adjustment of any selected group, or groups, of lights.

56 Claims, 5 Drawing Sheets

MULTI-ZONE, MULTI-SCENE LIGHTING CONTROL SYSTEM

BACKGROUND OF THE INVENTION

1. Field of the Invention

The present invention relates to an apparatus for individually controlling the intensity of multiple lighting groups, and more specifically, relates to a control system which allows many groups of lights to be controlled with few controls.

2. Description of the Related Art

In many situations where artificial lighting is used to create an environment conducive to a variety of activities, such as in a hotel lobby; or where it is desirable to emphasize certain features or areas in an architectural space, it is advantageous to be able to control the incident light intensity of the areas independently, so that lighting can be optimized in each area. Areas may be illuminated by groups (or "zones") of lighting fixtures that are controlled together. A control panel, adapted to control power (and, thus, light intensity) to each zone, provides a convenient way to create a desired ambience or "scene"; i.e., a particular combination of zone intensities.

A typical control panel designed to provide this function incorporates an array of slide actuators, each of which controls the light output of a zone. A scene can be created by setting the position of each slide actuator in the array to a desired level. More versatile control panels typically include more than one array of slide actuators to provide additional scenes. A selector knob or push buttons are used to select among the preset scenes that are mechanically stored as arrays of slide actuator positions.

An Aurora® control panel, manufactured by Lutron Electronics, Coopersburg, Pa., provides four arrays of six slide actuators for controlling up to six zones of lights. Because it is desirable to keep the wall-mounted control panel small and simple, electronic signals are sent to a remote dimming cabinet which dims each zone to the instructed level. The remote cabinet may be mounted in an electrical closet, where load wires are more accessible and heat dissiptation is less of a problem. Any one of four preset scenes are recalled by actuating corresponding push buttons.

It is often desirable to control a large number of zones and create many preset scenes that can be recalled later. If, for instance, twenty-four zones of lights were to be controlled, with eight possible preset scenes, a control panel similar to the Aurora® would have eight arrays, each containing twenty-four slide actuators, for a total of 192 slide actuators. Unfortunately, a panel this large would be bulky, cumbersome to use, and costly to produce.

Some other control panels employ a single array of slide actuators to independently adjust lighting zone intensities; i.e., only one slide actuator is used per zone. Preset scenes are stored in an electronic memory, such as a static RAM integrated circuit chip. The Series-7, manufactured by Prescolite Controls, of Carrollton, Texas, incorporates a single array of twelve slide actuators, to control the same number of zones, and an electronic memory for storing up to eleven preset scenes. Once a scene is set via the actuator array, it can be stored in an electronic memory by pressing a "record" button, thereby storing the position of each actuator in the array. Scenes are recalled by pressing the corresponding scene buttons.

One disadvantage of this control system is that scenes cannot be "fine-tuned". Suppose, for example, that you have consecutively set a number of scenes to your liking. In reviewing scene one, you decide that zone five requires adjustment. At this point, the slide actuator array corresponds to the most recently set scene, even though the lighting corresponds to scene one. In order to make this correction to scene one, you must readjust all slide actuators to create a new scene one and record it over the old scene. This can be quite a nuisance, for example, when twenty-four zones of lights are being controlled and more than a few fine adjustments are required.

To overcome this inconvenience and to create a simpler control, the Omega control system, manufactured by Electronics Diversified, of Hillsboro, Oregon, incorporates an encoder wheel, which provides a single intensity adjustment for all zones. Zones within a scene are adjusted by selecting the appropriate zone, adjusting the zone intensity via the encoder wheel, and then actuating the record button to store the change. Thus, it is possible to select, adjust, and record a single zone change in a prerecorded scene without affecting the rest of the scene.

In some applications, especially in public buildings, it is advantageous to be able to prevent present scenes from being erased or altered. A control panel with a key locking mechanism can limit access to scene-record actuators. In other circumstances, it is necessary to create new scenes, but desirable to retain the originals (set by the lighting designer, for example). The Omega control system includes a disk storage and recall system, which allows scenes to be stored on magnetic disks. The disks may then be kept in a separate location.

SUMMARY OF THE INVENTION

In accordance with the present invention, a lighting control system comprises, in combination:

(a) means for independently setting power levels to each of a plurality of zones of lighting, (b) means, requiring no operator action, for electronically storing a plurality of combinations of said power levels, and (c) means for selecting any one of said combinations of power levels.

DETAILED DESCRIPTION

Figure 1:
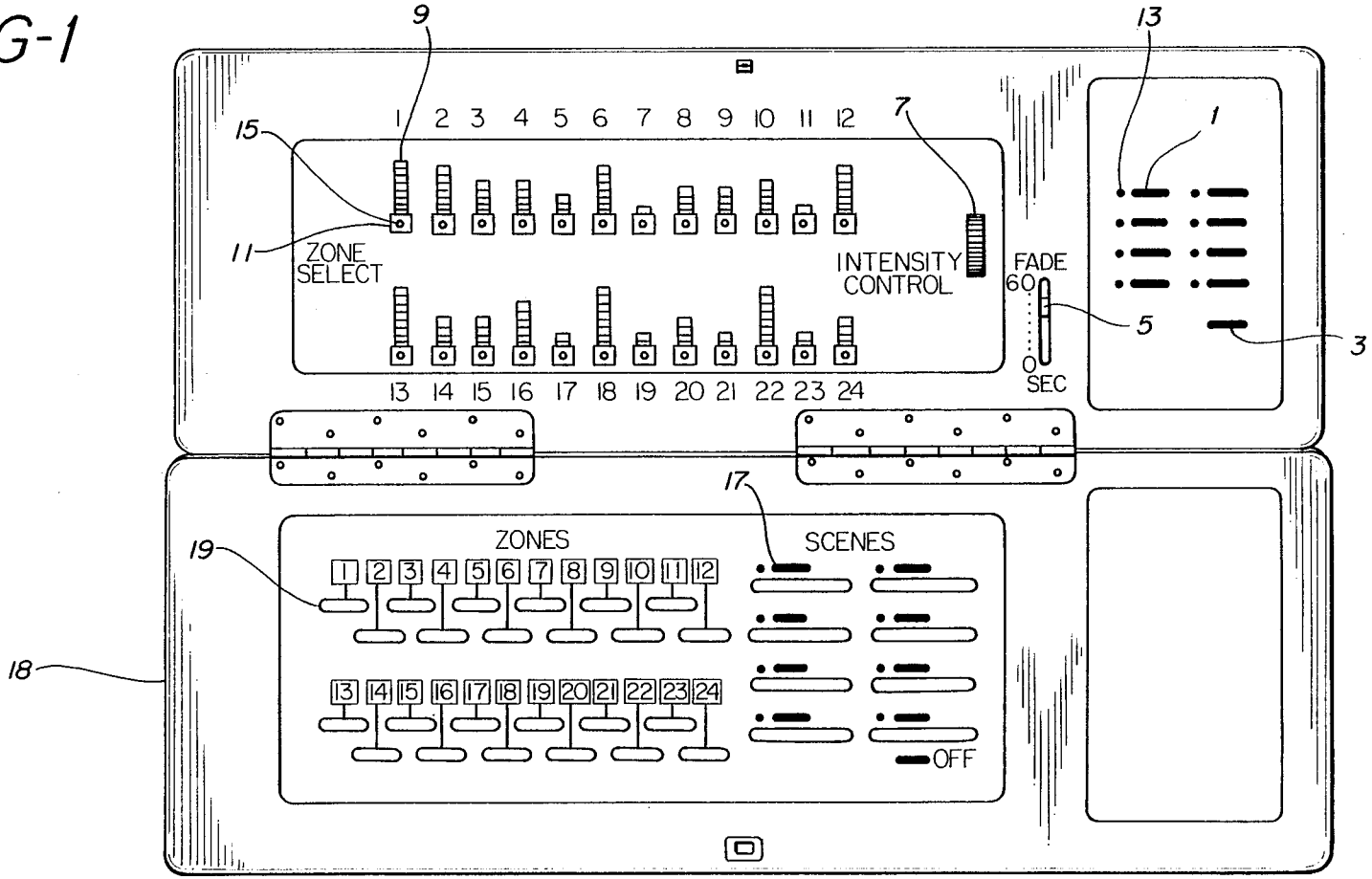
FIG. 1 shows a front view of a control panel of the present invention.

FIG. 1 depicts an embodiment of a control panel of the present invention for controlling up to twenty-four zones of lighting with eight possible preset scenes. The system operates as follows: a particular combination of twenty-four zone intensity levels (i.e. a scene) is selected by pressing one of eight scene select actuators 1, preferably a momentary contact push button. Optional scene select indicator 13, preferably a light emitting diode (LED), indicates when that scene has been selected and remains lit while that scene is active. Optional scene identifiers 17, which may be attached to the inside of hinged cover 18, identify the scenes that correspond to the scene select actuators 1. Actuator 3 is a power off switch: pressing it turns power to all zones off. Power can be restored by selecting any one of the eight preset scenes.

New scenes are created by adjusting zone intensities to desired lighting levels. Optional zone identifiers 19 identify the zones. A zone is selected for adjustment by pressing its corresponding zone selection actuator 11, preferably a momentary contact push button. Zone intensities are then set via the zone power level control 7, preferably an endless travel thumbwheel encoder. Rotating thumbwheel 7 up or down increases or decreases the intensity of the selected zone, respectively. Although FIG. 1 shows all zone intensities adjustable by a single control 7, it is also feasible for zone intensities to be adjustable via multiple controls.

Preferably, more than one zone may be simultaneously selected, the light intensity of each selected zone increasing or decreasing equally by an amount proportional to the displacement of thumbwheel 7. Alternatively, the percent increase or decrease in zone intensities may be proportional to thumbwheel displacement. Zone adjustments are automatically stored in memory.

Zone intensity is preferably indicated by a vertically aligned array of light emitting diodes 9, in which the number of diodes consecutively lit from the bottom indicates zone intensity. Alternatively, the position of a single illuminated diode in the array may indicate zone intensity. Zone selection indicator 15, perferably an LED, lights when its corresponding zone is selected for adjustment and remains lit until the zone is deactivated; i.e., "deselected". Optionally, lights in the selected zone may be flashed to physically indicate selected lights.

In a preferred embodiment, zones are deselected by pressing the zone selection actuator a second time. The zone selection actuator may be an alternate action push button, which, when pressed, opens a pair of closed contacts or closes a pair of open contacts. Alternatively, zones may be deselected by a time lapse after adjusting zone intensities or by selection of another zone after adjusting zone intensities.

When a preset scene is selected, lights in each of the twenty-four zones fade from the previous scene to the selected scene over a period of time. This fade time is preferably adjustable via optional fade adjustment potentiometer actuator 5. Alternatively, thumbwheel 7 may be adapted to adjust fade time as well as zone intensities. Preferably, all scenes have the same fade time; however, it is possible to apply separate fade times for each scene and for fade-up and fade-down, if desired.

Optionally, thumbwheel 7 could provide a convenient way to proportionally dim an entire scene (i.e., dim all zones in a scene proportionally). It may be enabled by default if the encoder wheel is displaced while no zones are enabled, or it may be enabled by a separate scene dim actuator (not shown).

Hinged cover 18 opens and closes to allow or deny access to zone selection actuators 11, thumbwheel 7, and fade adjustment actuator 5. Scene select actuators 1 remain accessible when hinged cover 18 is closed. The hinged cover may be translucent, to allow viewing of zone intensity indicators 9, or it may be opaque.

Figure 2:
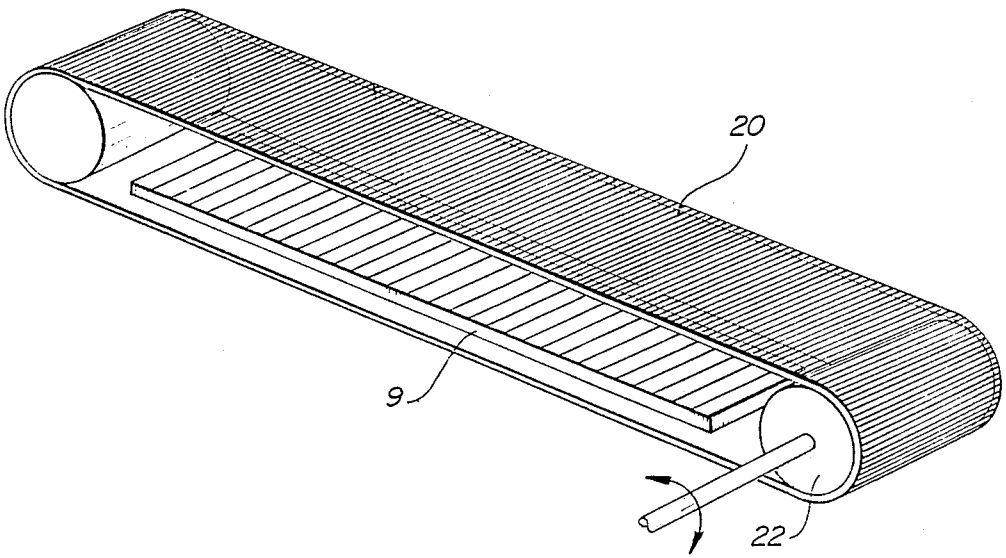
FIG. 2 is a drawing of a treadmill rotary encoding scheme.

FIG. 2 illustrates a "treadmill" rotary encoder scheme which may be used in place of thumbwheel 7 to set zone intensity levels. Sliding a finger up or down the knurled surface of treadmill 20 rotates encoder wheel 22, increasing or decreasing the zone intensity level. Preferably, treadmill 20 is translucent and the LED bar graph 9, which indicates zone intensity, is visible through it, each zone being controlled by a corresponding treadmill encoder.

Figure 3:
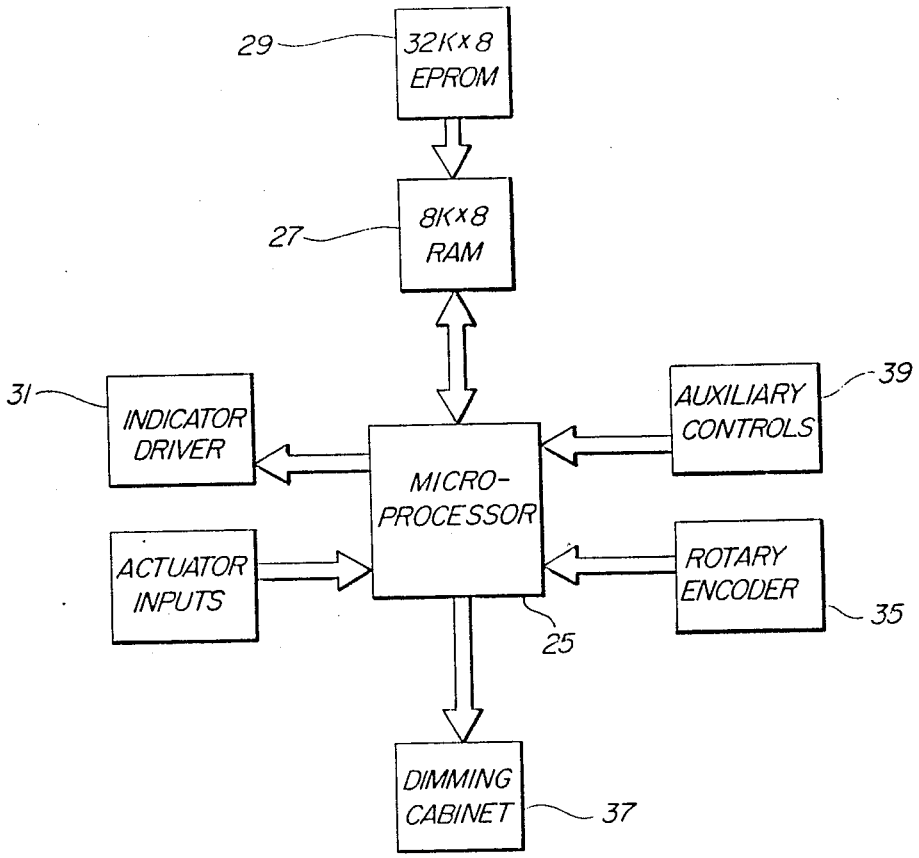
FIG. 3 is a block diagram showing the logic structure of a control system of the present invention.

FIG. 3 depicts a block diagram of a control system of the present invention. Microprocessor 25 is the central control device, which instructs the dimming cabinet 37, executes programming functions, and operates the indicator driver 31. Operating instructions for microprocessor 25 are stored in a 32K×8 EPROM memory chip 29.

When zones are selected for adjustment, a microprocessor 25 reads rotary encoder 35 to detect rotation and direction of travel. It then sends a multiplexed signal to a remote dimming cabinet 37, instructing it to increase or decrease the corresponding zone power levels. Adjusted values become part of the active lighting scene and the corresponding preset scene, stored in an 8K×8 bit random access memory (RAM) chip 27.

Indicator driver 31 receives control information from microprocessor 25, instructing it to turn appropriate indicators on or off to indicate zone power levels and selected zones and scenes.

The present invention may optionally permit use of auxiliary controls 39, which may include a remotely locatable wall-mounted scene selector, a wireless remote scene selector, or a hand-held programmer, among others. Preferably, a wall-mounted auxiliary scene selector provides actuator buttons for selecting any of the preset scenes stored in RAM chip 27, and can be mounted remotely from the control system to which it is electrically connected. A wireless remote scene selector preferably provides actuator buttons for selecting any of the preset scenes and includes an infrared transmitter to send selection information to a receiver that is electrically connected to the control system. A hand-held programmer preferably includes controls necessary to set scenes (i.e. zone selection/deselection actuators, fade rate adjustment actuator, and a rotary encoder) and may be connectable to the control system via multiplex signal carrying wires. Optionally, the hand-held programmer may be a wireless remote control. Preferably, a wireless programmer includes auxiliary scene select actuators for selecting scenes to be set.

According to the present invention, scenes are stored in an electronic memory, which is updated after each zone adjustment. In this manner, any changes made to a preset scene are automatically stored in memory, without requiring use of additional "store" and "recall" actuators. In conjunction with an encoder wheel, this "transparent" electronic memory allows quick and easy adjustments to be made to any zone within a preset scene without disturbing remaining zones in the scene.

Figure 4:
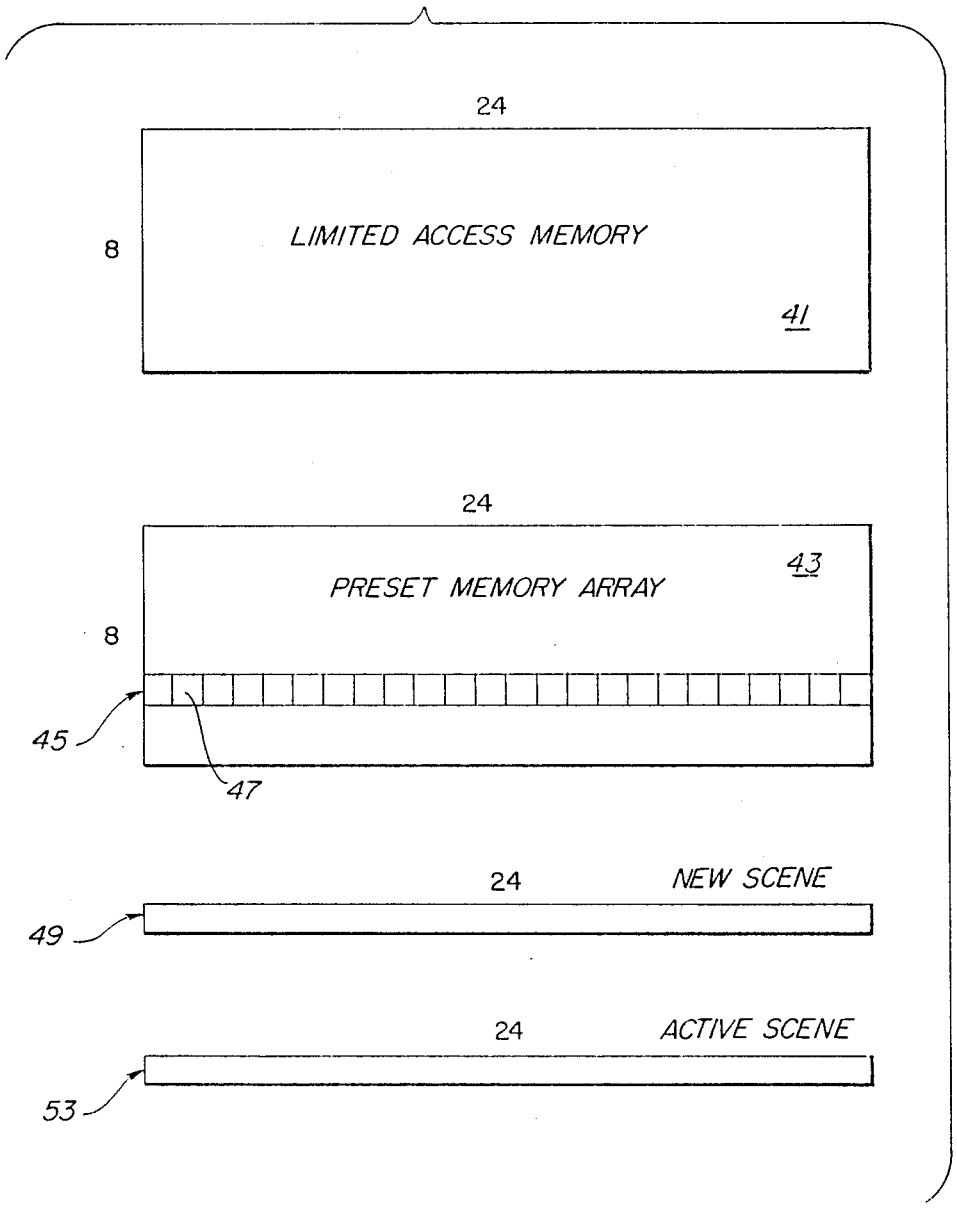
FIG. 4 is a memory map illustrating an embodiment of an electronic memory.

FIG. 4 is a memory map of the 8K×8 bit RAM 27 used to electronically store scenes. Active zone power levels are stored in a 24×8 bit "active scene" register 53 that is updated approximately every eighth of a second. Preset scenes are stored in an 8×24×8 bit memory array 43.

Upon selecting a preset scene, its corresponding 24×8 bit register 45, containing twenty-four power level settings 47, is loaded into a "new scene" register 49. The active scene is then faded to the new scene by repeatedly increasing or decreasing each zone power level, in the active scene register 53, by an amount proportional to the difference between the active and new zone power levels divided by the fade time. Zone power levels change during the fade time, after which the active scene register 53 is equal to the new scene register 49. All zones reach their new power levels at substantially the same time.

In order to protect important scenes, the present invention optionally provides for a limited access memory. Scenes stored in the limited access memory array 41, can only be accessed via a key. Alternatively, limited access array 41 may be accessible by activating a special combination of actuators. All eight scenes in the preset scene memory array 43 may be recalled and adjusted by any user, but changes will not be saved to limited access array 41 unless it has been accessed. When limited access array 41 is accessed, values stored in it are copied into the preset scene memory array 43, and subsequent changes made to preset scenes are stored in both arrays 41 and 43.

Figure 5:
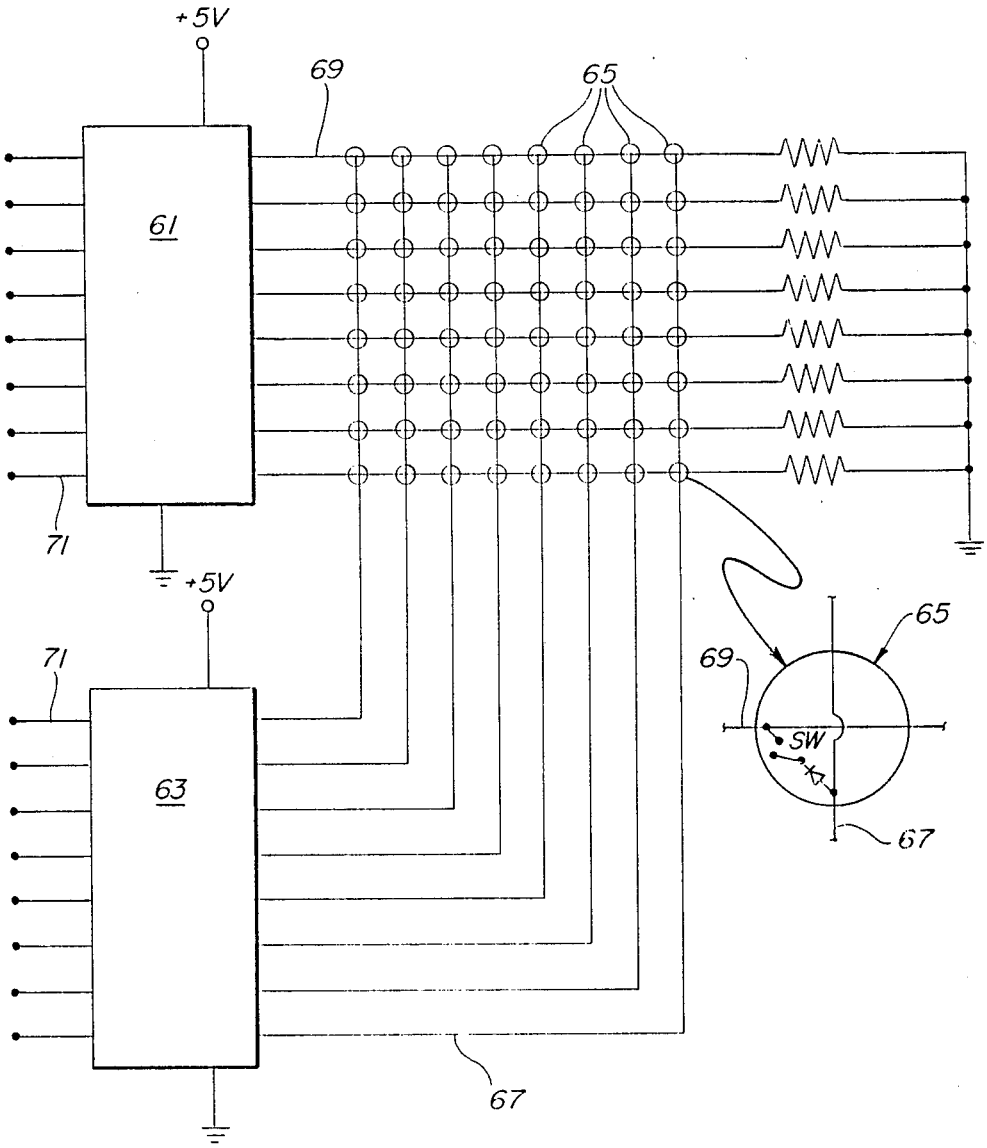
FIG. 5 illustrates a keyboard matrix connection.

In a preferred embodiment of the present invention, scene and zone selection actuators are electrically connected in a keyboard matrix configuration, as illustrated in FIG. 5. Activating an actuator 65 electrically connects corresponding column conductor 67 and row conductor 69. Column driver 63 continuously sends consecutive high bits to each of its eight column conductors 67. When received by row receiver 61, the high bit indicates an activated switch, whose matrix address corresponds to the position of the sending conductor on the column driver 63 and the position of the receiving conductor on the row receiver 61. Address information is conveyed back to microprocessor 25 (see FIG. 4) via data lines 71.

Since certain changes may be made in the above apparatus without departing from the scope of the invention herein involved, it is intended that all matter contained in the above description or shown in the accompanying drawings shall be interpreted in an illustrative and not a limiting sense.

We claim:

1. A lighting control system comprising, in combination:

(a) means for independently setting power levels to each of a plurality of zones of lighting, (b) means, requiring no operator action, for electronically storing a plurality of combinations of said power levels, and (c) means for selecting any one of said combinations of power levels.

2. The control system of claim 1, further comprising means for adjusting said power level setting means.

3. The control system of claim 2, wherein said adjusting means comprises a rotary encoder.

4. The control system of claim 3, wherein said rotary encoder comprises an endless travel thumbwheel.

5. The control system of claim 3, further comprising zone selection means to select a zone for power level setting.

6. The control system of claim 5, wherein said zone selection means comprises a push button actuator.

7. The control system of claim 5, wherein power levels of a plurality of selected zones can be set simultaneously.

8. The control system of 7 wherein changes in said power levels are proportional to the displacement of said rotary encoder.

9. The control system of 7 wherein percent changes in said power levels are proportional to the displacement of said rotary encoder.

10. The control system of claim 5, further comprising means for indicating said selected zone.

11. The control system of claim 10, wherein said zone indicating means comprises a light emitting diode.

12. The control system of claim 10, wherein said zone indicating means is adapted to flash said selected zone of lights.

13. The control system of claim 5, further comprising zone deselection means to prevent power level setting of a zone.

14. The control system of claim 13, wherein said zone selection means is adapted to select a zone when actuated once and to deselect a zone when actuated twice.

15. The control system of claim 14, wherein said zone selection means comprises an alternate action push button actuator.

16. The control system of claim 13, wherein said zone deselection means comprises a timer adapted to deselect a zone at a predetermined interval after said zone has been adjusted.

17. The control system of claim 5, wherein said zone selection means is adapted to, upon actuation, deselect previously adjusted zones.

18. The control system of claim 2, wherein said adjustment means comprises an endless travel linear encoder.

19. The control system of claim 18, wherein said endless travel linear encoder comprises a treadmill mounted on a rotary encoder.

20. The control system of claim 19, wherein said treadmill is translucent.

21. The control system of claim 20, further comprising means for indicating said zone power levels mounted behind said translucent treadmill.

22. The control system of claim 2, wherein said adjusting means is removably connectable to said power level setting means.

23. The control system of claim 2, further comprising auxiliary means for adjusting said power level setting means.

24. The control system of claim 23, wherein said auxiliary adjusting means comprises a wireless transmitter.

25. The control system of claim 24, wherein said wireless transmitter is an infrared transmitter.

26. The control system of claim 1, further comprising means for indicating said zone power levels.

27. The control system of claim 26, wherein said power level indicating means comprises a light emitting diode.

28. The control system of claim 27, wherein said power level indicating means comprises an array of light emitting diodes, the number of which successively illuminated indicates said zone power level.

29. The control system of claim 28, wherein said array is vertically aligned.

30. The control system of claim 27, wherein said power level indicating means comprises an array of light emitting diodes, and the position of a single illuminated diode indicates said zone power level.

31. The control system of claim 1, wherein said power level combination selecting means comprises a push buton actuator.

32. The control system of claim 1, further comprising means for indicating a selected power level combination.

33. The control system of claim 32, wherein said selection indicator means comprises a light emitting diode.

34. The control system of claim 1, wherein said power level combination selecting means is removably connectable to said power level setting means.

35. The control system system of claim 1, further comprising auxiliary means for selecting any one of said power level combinations.

36. The control system of claim 35, wherein said auxiliary power level combination selecting means comprises a wireless transmitter.

37. The control system of claim 1, further comprising fade means for prolonging the transition to a selected preset power level combination.

38. The control system of claim 37, further comprising means for adjusting the transition time of said fade means.

39. The control system of claim 38, wherein said transition time adjustment means comprises a potentiometer.

40. The control system of claim 38, wherein said transition time adjustment means is removably connectable to said power level setting means.

41. The control system of claim 38 further comprising auxiliary means for adjusting the transition time of said fade means.

42. The control system of claim 41 wherein said auxiliary transition time adjustment means comprises a wireless transmitter.

43. The control system of claim 3, further comprising fade means for prolonging the transition to a selected preset power level combination.

44. The control system of claim 43, in which said rotary encoder is adapted for adjusting the transition time of said fade means.

45. The control system of claim 1, further comprising means for simultaneously adjusting all power levels in a combination.

46. The control system of claim 5, wherein said power level setting means is adapted to allow simultaneous adjustment of all power levels in a combination, if no zones are selected.

47. The control system of claim 1, further comprising a hinged cover that opens and closes to allow and deny access to said power level setting means.

48. The control system of claim 47, further comprising means, attached to said cover, for identifying said zones.

49. The control system of claim 48, wherein said zone identifying means comprises an array of labels, each label in said array being positioned so as to identify it with a corresponding zone selection actuator.

50. The control system of claim 47, further comprising means, attached to said cover, for identifying said scenes.

51. The control system of claim 50, wherein said scene identifying means comprises an array of labels, each label in said array being positioned so as to identify it with a corresponding scene selection actuator.

52. The control system of claim 1 further comprising means for storing selected combinations of power levels in a limited access memory.

53. The control system of claim 52, wherein said limited access storage means comprises an electronic memory.

54. The control system of claim 53, further comprising a key locking means to control access to said limited access storage means.

55. The control system of claim 53, further comprising a circuit adapted for allowing access to said limited access storage means in response to a particular activation sequence of zone selection means or power level combination selection means.

56. A lighting control system comprising, in combination:

(a) means for independently setting power levels to each of a plurality of zones of lighting, (b) means, requiring no operator action, for electronically storing a plurality of combinations of said power levels, (c) operator-activated means for disabling said electronic storge means, and (d) means for selecting any one of said combinations of power levels.

* * * * *